United States Patent [19]

Bonne et al.

[11] Patent Number: 4,844,914

[45] Date of Patent: Jul. 4, 1989

[54] INFUSION BAG FOR MAKING IN PARTICULAR COFFEE BEVERAGES

[75] Inventors: Harry Bonne, Meilen, Switzerland; Manfred Nothnagel, Sottrum-Fährhof, Fed. Rep. of Germany

[73] Assignee: Jacobs Suchard GmbH, Bremen, Fed. Rep. of Germany

[21] Appl. No.: 941,174

[22] Filed: Dec. 12, 1986

[30] Foreign Application Priority Data

Dec. 14, 1985 [DE] Fed. Rep. of Germany ..... 3544263

[51] Int. Cl.[4] ..... B65B 29/04; B65D 33/06

[52] U.S. Cl. ..... 426/79; 426/80; 426/82; 99/287; 99/295; 99/323; 206/0.5

[58] Field of Search ..... 426/77-84; 99/287, 295, 321, 322, 323; 206/0.5

[56] References Cited

U.S. PATENT DOCUMENTS

| | | | |
|---|---|---|---|
| 1,362,054 | 12/1920 | Stockman | 426/83 |
| 1,665,080 | 4/1928 | Abbott | 426/82 |
| 2,072,976 | 3/1937 | Andrus | 99/323 |
| 2,123,054 | 7/1938 | Lamb et al. | 426/80 |
| 2,143,302 | 1/1939 | Cross | 426/79 |
| 2,272,530 | 2/1942 | Patterson | 206/0.5 |
| 2,285,113 | 6/1942 | Eaton | 426/80 |
| 2,291,278 | 7/1942 | Cleaves | 426/82 |
| 2,359,292 | 10/1944 | Barnett | 426/82 |
| 2,362,459 | 11/1944 | Barnett | 426/394 |
| 2,922,717 | 1/1960 | Whelan | 426/79 |
| 2,925,171 | 2/1960 | Eaton | 426/394 |
| 2,954,294 | 9/1960 | Whelan | 426/79 |
| 3,053,665 | 9/1962 | Irmscher | 426/79 |
| 3,257,212 | 6/1966 | Kasket | 426/82 |
| 3,542,561 | 11/1970 | Rambold | 426/79 |
| 3,597,222 | 8/1971 | Kalemba | 426/79 |
| 3,607,302 | 9/1971 | Beck | 426/83 |
| 3,833,740 | 9/1974 | Schmidt | 426/115 |
| 3,895,118 | 7/1975 | Rambold | 426/82 |
| 4,055,668 | 10/1977 | Kopp | 426/79 |
| 4,211,156 | 7/1980 | Zimmermann | 426/80 |
| 4,229,481 | 10/1980 | Fornari | 426/82 |
| 4,278,691 | 7/1981 | Donarumma et al. | 426/80 |
| 4,443,481 | 4/1984 | Donarumma et al. . | |
| 4,605,123 | 8/1986 | Goodrum et al. | 426/82 |
| 4,651,870 | 3/1987 | Giambalvo | 426/82 |

FOREIGN PATENT DOCUMENTS

| | | | |
|---|---|---|---|
| 95542 | 12/1983 | European Pat. Off. . | |
| 158511 | 10/1985 | European Pat. Off. . | |
| 914425 | 7/1954 | Fed. Rep. of Germany . | |
| 1795868 | 9/1959 | Fed. Rep. of Germany . | |
| 566910 | 9/1975 | Fed. Rep. of Germany . | |
| 8434750 | 11/1984 | Fed. Rep. of Germany . | |
| 881784 | 11/1961 | United Kingdom | 426/79 |

*Primary Examiner*—Steven Weinstein

*Attorney, Agent, or Firm*—Burns, Doane, Swecker & Mathis

[57] ABSTRACT

An infusion bag for making beverages from extractable substances includes first and second subchambers that are connected to each other at their upper and lower transverse edges. A rigid actuating handle having a rigid transverse web, is connected to the subchambers and permits the subchambers to be subjected to up and down movements so that infusion of the extractable substances can occur in a very short time.

12 Claims, 5 Drawing Sheets

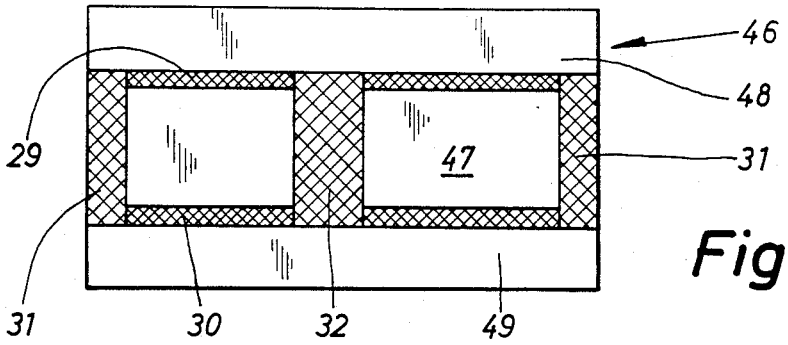
Fig. 11
Fig. 12
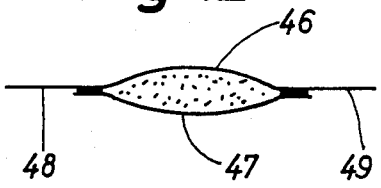
Fig. 13
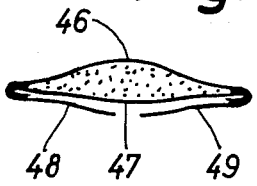
Fig. 14
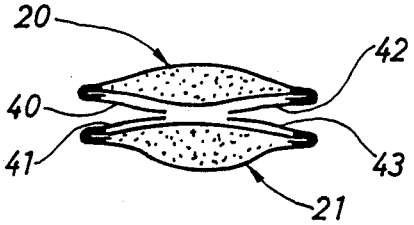
Fig. 15
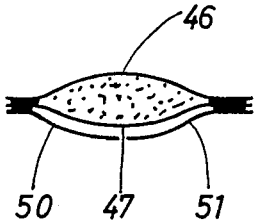
Fig. 16
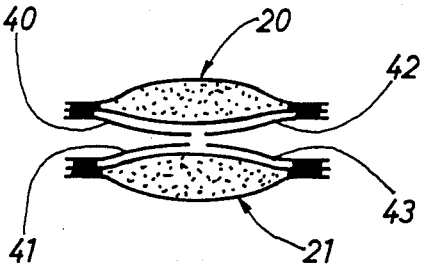
Fig. 17
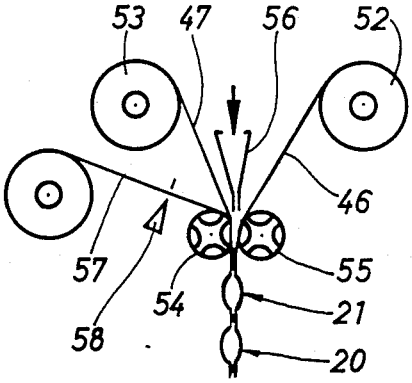

INFUSION BAG FOR MAKING IN PARTICULAR COFFEE BEVERAGES

DESCRIPTION

The invention relates to an infusion bag of filter material, in particular filter paper, for making beverages in a container from extractable substances, in particular ground roasted coffee, with legs which are connected to one another at the upper end and have subchambers for accommodating one subportion each of the roasted coffee or the like being formed by folding the double-layered filter paper in a U-shape.

In the case of certain extractable substances, in particular in the case of ground roasted coffee, success has not been achieved hitherto in the preparation of qualitatively satisfactory beverages by means of infusion bags. The reason for this is that, for adequate extraction of the roasted coffee, water has to flow through the coffee portion in order to ensure adequate extraction. On the other hand, an adequately impervious filter paper is necessary in order to largely avoid the escape of solid particles from the infusion bag into the beverage.

The object of the invention is to made an infusion bag available which is suitable in particular for the quick preparation of coffee beverages of roasted coffee without a reduction in quality compared with conventionally prepared coffee beverages.

To achieve this object, the infusion bag according to the invention is characterized in that the subchambers, with their upper edges, are connected (together) to a rigid actuating handle in such a way that, by up and down movements of the actuating handle, the subchambers execute oppositely directed transverse movements while supported on a container bottom (cut bottom).

The invention is based on the discovery that an infusion bag for the preparation of coffee beverages in particular has to be made such that a "pumping movement" which is otherwise not usual for the preparation of beverages by means of infusion bags can be transmitted to the infusion bag by means of the actuating handle in such a way that a through-flow effect and thus an effective extraction of short duration is achieved by this movement.

The infusion bag is accordingly designed according to the invention such that, by up and down movement of the largely rigid actuating handle, a hollow space—pumping chamber—which varies in shape and size is created between closed subchambers having subportions. As a result of the movement described, water flows into this hollow space and emerges again, namely through the subchambers. By the up and down movement of the actuating handle, deformation pressure is exerted on the infusion bag supported on the container bottom (cup bottom), which deformation pressure leads to an increase and a reduction in the hollow space (pumping chamber) and thus to the formation of a vacuum and a positive pressure in the latter.

The subchambers are connected to one another and to the actuating handle respectively at the upper and lower transverse edge, so that a variable hollow space is formed as a pumping chamber between the chambers.

The effect which is intended with the invention can be improved by the hollow space (pumping chamber) formed between the subchambers being provided at the open sides with closure flaps which act like a non-return valve during the up and down movement of the actuating handle. A higher internal pressure can thereby build up in the pumping chamber, which internal pressure forces the flow of the water outwards through the subchambers.

An infusion bag of such a configuration is made according to the invention from two simple designed blanks of filter material (filter paper). The subchambers are at the same time closed all round by welded or bonded seams. An outer blank is made with a larger width than the inner blank in such a way that a lateral strip projection is formed which, after folding over, forms the closure flaps (valve flaps).

According to the invention, the subchambers are kept at a greater distance from one another in the lower area, namely by a filter material strip free of roasted coffee and formed preferably by a correspondingly wide lower transverse seam. The subchambers can thereby execute greater transverse movements relative to each other during the pumping movements.

Further features of the invention relates to the design of the infusion bag and also to its manufacture.

BRIEF DESCRIPTION OF THE DRAWINGS

Exemplary embodiments of the infusion bag according to the invention and also of devices for manufacturing it are schematically shown in the drawings, in which:

FIG. 11 shows an intermediate product for the manufacture of an infusion bag according to FIGS. 5 to 10 in plan view, FIG. 12 shows a horizontal cross-section for the representation according to FIG. 11, FIG. 13 shows a production intermediate position of an infusion bag in horizontal cross-section, FIG. 14 shows a horizontal cross-section representation of the ready-folded infusion bag from blanks according to FIG. 11, FIG. 15 shows a further embodiment of an infusion bag in horizontal cross-section analogous to FIG. 13, FIG. 16 shows the ready-folded infusion bag for the exemplary embodiment according to FIG. 15 in horizontal cross-section, FIG. 17 shows a device for manufacturing infusion bags in the embodiment according to FIGS. 15 and 16 in considerably simplified representation.

Figure 1:
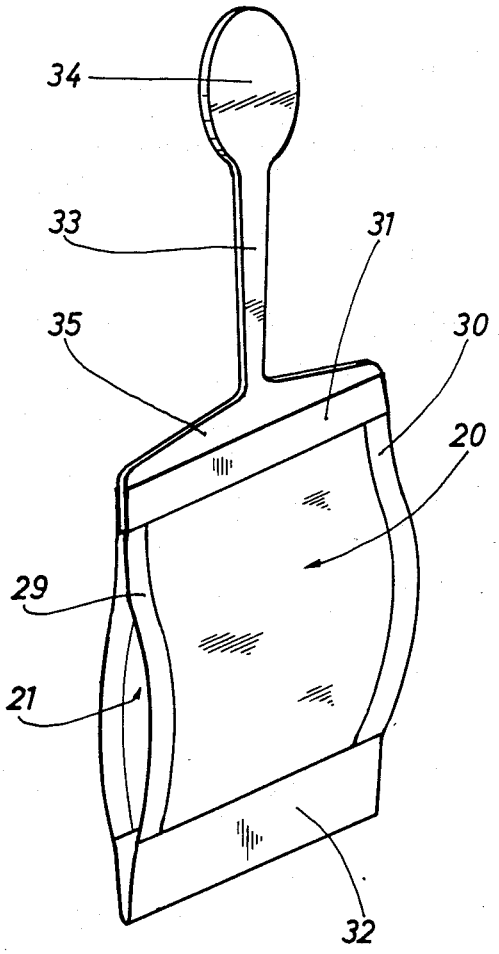
FIG. 1 shows an exemplary embodiment of a (coffee) infusion bag in perspective representation.

The infusion bags shown of sealable filter paper are primarily intended for the preparation of coffee beverages from ground roasted coffee. Each infusion bag consists of several, namely two subchambers 20 and 21, each of which is used for accommodating a subportion 22 and 23 of ground roasted coffee. The total quantity of the ground roasted coffee corresponds to the requisite coffee portion for making a coffee beverage, in particular a cup portion. For this preferred range of application of the preparation of an individual portion of the coffee beverage in a cup 24, the total portion of ground roasted coffee is about 7.5 g.

The subchambers 20 and 21 are formed by chamber walls 25 and 26, and 27 and 28 respectively of filter material, in particular filter paper. The chamber walls 25 to 28 are connected to one another at the sides by side seams 29 and 30 and also at the top and bottom by transverse seams 31 and 32, so that the subchambers 20 and 21 have an internal volume of adequate size. The subchambers 20 and 21 are connected to one another in the area of the lower transverse seams 32. The upper transverse seams 31 are fixed to an actuating member, namely to an actuating handle 33.

The actuating handle 33 is made such that, when the infusion bag is manipulated, a certain pressure can be exerted on the object consisting of the subchambers 20 and 21 without this causing significant deformation of the actuating handle 33. For this purpose, the latter preferably consists of plastic, e.g. rigid PVC. The actuating handle 33 can be punched out as a shaped part, for example from plate material. For gripping the infusion bag, the actuating handle 33 is here provided with a circular widened portion 34 at the upper end. For connecting to the subchambers 20 and 21 and also for the transverse stiffening of the infusion bag, the actuating handle 33, at a lower end, is provided with a transverse web 35 which extends approximately over the width of the subchambers 20 and 21. The upper transverse seams 31 are connected to the transverse web 35, in particular welded or bonded to its outer sides.

Figure 2:
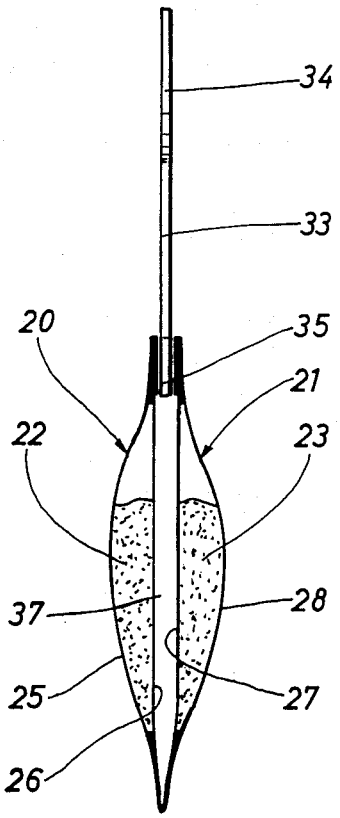
FIG. 2 shows a vertical section or a side view of the infusion bag according to FIG. 1.
Figure 3:
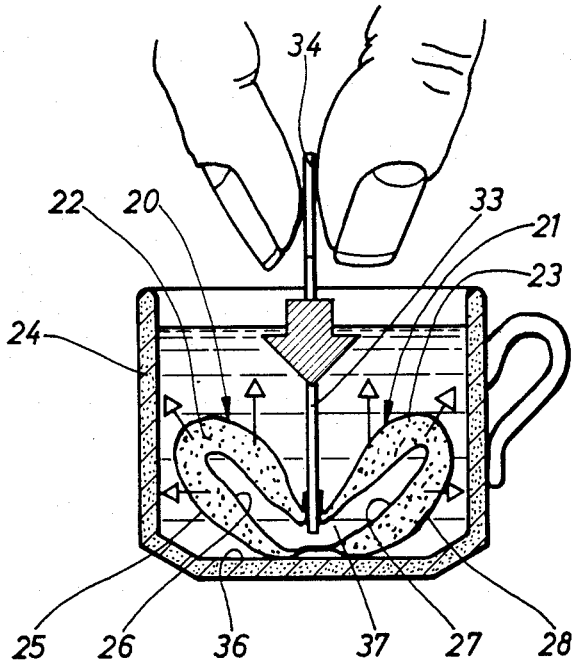
FIG. 3 shows a phase of the preparation of a (coffee) beverage in side view or in vertical section.
Figure 4:
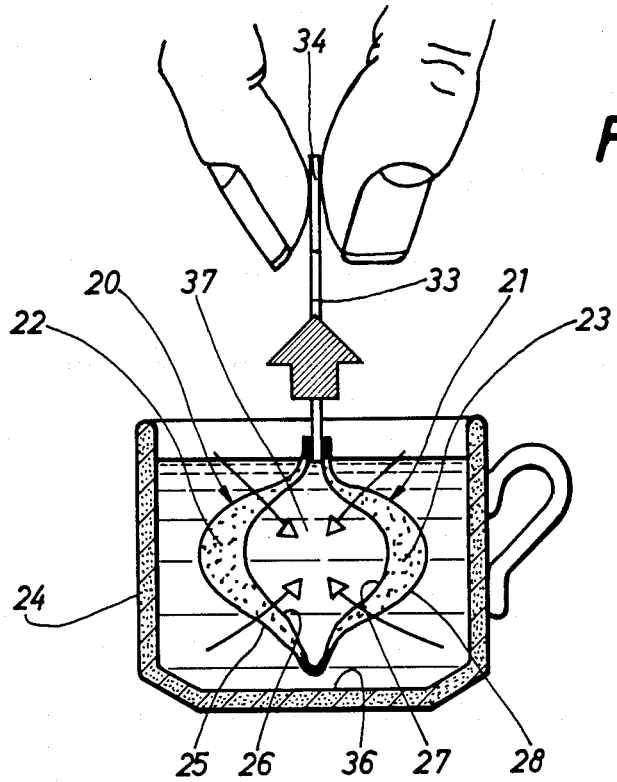
FIG. 4 shows another phase of the beverage preparation in a representation similar to FIG. 3, FIGS. 5 to 10 show various phases in the preparation of a (coffee) beverage with another exemplary embodiment of an infusion bag, in each of FIGS. 5, 7 and 9 in vertical section or in side view and in each of FIGS. 6, 8 and 10 in horizontal section.

The manipulation of the infusion bag thus made follows primarily from FIGS. 3 and 4. The infusion bag is gripped in the area of the widened portion 34 of the actuating handle 33 and, with the area of the subchambers 20 and 21, is dipped into the cup 24 filled with hot water. The lower edge of the subchambers 20 and 21, namely the transverse seams 32 connected to one another, is supported on the cup bottom 36. The halves of the infusion bag which are formed from the subchambers 20 and 21 are moved relative to one another in opposite directions by moving the actuating handle 33 up and down. During this procedure, the hollow space comes into effect which is formed between the units consisting of the subchambers 20 and 21 and which acts as a pumping chamber 37. The latter, during the up and down movements of the actuating handle 33, is changed in size and shape. When the infusion bag is dipped into the water for infusing or is supported on the cup bottom 36, the pumping chamber 37, which is relatively narrow in the initial position (FIG. 2), is opened out, as a result of which water for infusing not only flows via the free, open sides into the pumping chamber 37 but also through the subchambers 20 and 21. During further movement, namely during the movement of the actuating handle 33 down against the cup bottom 36, the pumping chamber 37 is reduced again, as a result of which the penetrated water flows laterally and outwards through the subchambers 20 and 21 (FIG. 3). Upon renewed upwards movement, the water flows in the opposite direction, as shown in FIG. 4.

By several such "pumping movements" water for infusing optimally flows through the subchambers 20 within a short time and the subportions 22 and 23 are accordingly extracted.

Figure 5:
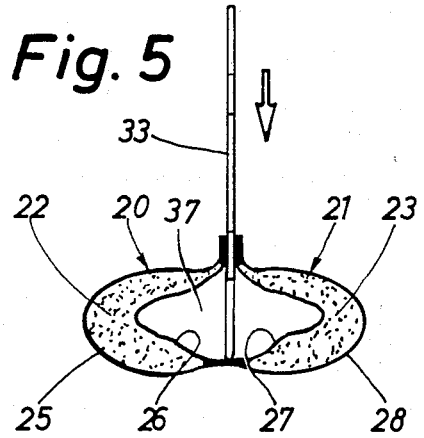

In order to improve the flow through the subchambers 20 and 21, measures are provided according to the exemplary embodiment of FIG. 5 which, during the reduction phase of the pumping chamber 37 filled with water, prevent or reduce flowing off via side openings 38 and 39. For this purpose, in the improved embodiment, shutoff flaps 40 and 41, 42 and 43 respectively, in the area of the side openings 38 and 39, are installed between the subchambers 20 and 21 and area arranged such that, during pressurizing, they are moved into a closing position (FIG. 6) by the water for infusing which is located in the pumping chamber 37 and is forcing its way outwards. The shut-off flaps 40 to 43 accordingly act like non-return valves.

In the exemplary embodiment shown, the shut-off flaps 40 to 43—of paper, plastic or the like—are fixed with external edges to the upright side seams 29 and 30 of the subchambers 20 and 21, namely on the side facing towards the pumping chamber 37. The fixing is such that, in the initial position, when the infusion bag is folded flat, the shut-off flaps 40 to 43 are likewise folded flat in between the subchambers 20 and 21 while bearing against the facing inner chamber walls 26 and 27. When the infusion bag is opened out during the pumping movements, namely when the pumping chamber 37 is being filled with water for infusing, the shut-off flaps 40 to 43 are moved into a position in which, on the one hand, they are connected to the side seams 29 to 30 and, on the other hand, with free internal sealing lips 44 and 45, bear against one another approximately in the centre plane of the pumping chamber 37. This closing position of the shut-off flaps 40 to 43 is supported or stabilized by the relevant shut-off members coinciding at the top and bottom, namely by being bound in between the transverse seams 31 and 32.

Figure 6:
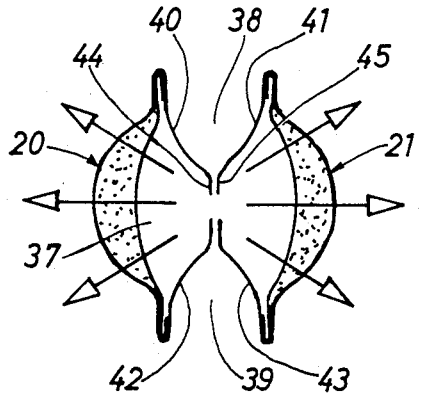

By the shutting off of the side openings 38 and 39, the water, during the following reduction in the volume of the pumping chamber 37, can no longer flow off predominantly via the side openings 38 and 39 but increasingly comes through the subchambers 20 and 21 with the effect of an accelerated, effective extraction (FIGS. 5 and 6).

Figure 7:
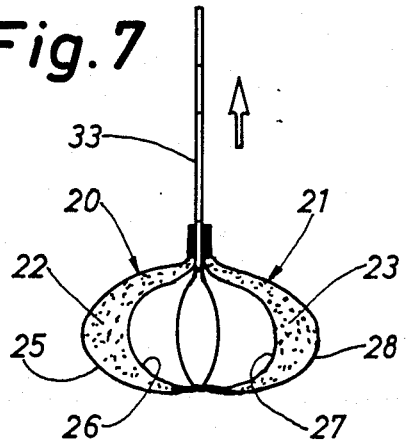
Figure 8:
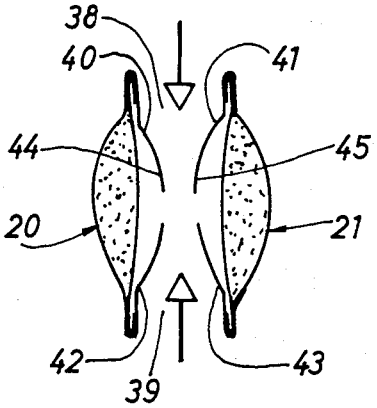

During the following upwards movement of the actuating handle 33, that is, after the pumping chamber 37 has been largely emptied, the subchambers 20 and 21 move into a mutual relative position in which water flows from outside into the pumping chamber 37, namely via the side openings 38 and 39. The shut-off flaps 40 to 43 are at the same time moved in the direction of the inner chamber walls 26 and 27, so that the inflow effect can take place unimpaired (FIGS. 7 and 8).

Figure 9:
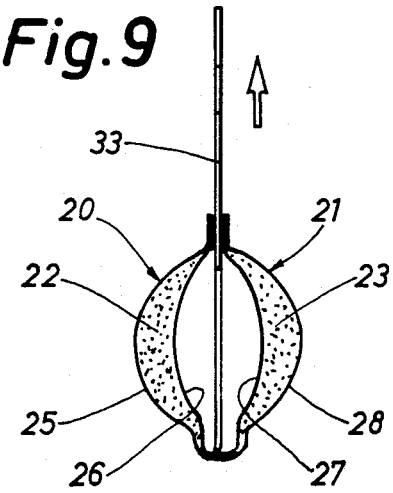
Figure 10:
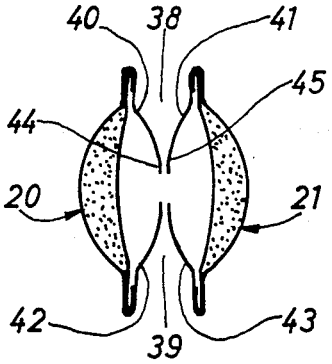

After the pumping chambers 37 are filled with water for infusing, namely after the upper end position of the actuating handle is reached, the side openings 38 and 39 are again closed by the shut-off slaps 40 to 43 by the build up of internal pressure in the pumping chamber 37 (FIGS. 9 and 10).

Filter bags can also be manufactured on a large scale in economical manner in the embodiment according to FIGS. 5 to 10. In the design according to FIGS. 11 to 14, the subchambers 20 and 21, including the shut-off flaps 40 to 43, consist of two blanks 46 and 47 of filter paper. The blank 46 which s located on the outside in the finished infusion bag is dimensioned with a larger width than the internal blank 47 in such a way that blank strips 48 and 49, in an intermediate position according to FIGS. 11 and 12, project away laterally beyond the inner blank 47. In this position, the blanks 46 and 47 are connected to one another by the side seams 29 and 30 and also by the transverse seams 31 and 32, the latter combined into a common transverse seam of double width, after the subportions 22 and 23 have been poured into the forming subchambers 20 and 21 beforehand or during the connection of the blanks 46 and 47 to one another. In an elongated arrangement of the object, the blank strips 48 and 49 are then folded over against the free side (inner side) of the inner blank 47 (FIG. 13). Thus the shut-off flaps 40 to 43 develop, with the blanks trips 48 and 49 being of such a size that they extend approximately up to the centre of the subchambers 20 and 21.

Alternatively, the internal blank 47 can also be made with a larger width, with blanks trips on the edge side being folded over inwards in order to form the shut-off flaps 40 to 43 as described.

The more or less finished infusion bag is now folded over in the area of the lower transverse seams 32 directly adjoining one another, so that the subchambers 20 and 21 are located directly adjacent to one another. The upper transverse seams 31 are now connected to one another or to the actuating handle 33. During this folding process, the shut-off flaps 40 to 43 automatically move into the effective position.

An infusion bag embodiment which is likewise especially suitable for large-scale production is shown in FIGS. 15 and 16, in each case in the cross-section of a subchamber 20 and 21. The blanks 46 and 47, which are of the same width or same size, are connected to one another in the manner described by welding or bonding while the subchambers 20 and 21 are formed and the subportions 22 and 23 are accommodated. In addition, material strips 50 and 51 sitting against the internal blank 47 are attached to the (subsequent) inner side or to the internal blank 47 and are connected to the blank 47 in the area of the side seams 29 and 30 running in the longitudinal direction. The material strips 50 and 51—of paper, plastic or the like—are so wide that they extend virtually up to the centre plane of the subchambers 20 and 21.

The continuous object thus formed is then cut through in the area of adjacent transverse seams 32, so that units develop approximately in the embodiment of FIG. 11—without blank strips 48 and 49. The infusion bag develops by folding over in the area of the lower transverse seams 32, to which infusion bag the actuating handle is still to be attached.

In the production of infusion bags of this type, the procedure can be adopted as shown schematically in FIG. 17. The track-shaped material for forming the blanks 46 and 47 is drawn off continuously from reels 52 and 53. In the area of form rollers 54 and 55 located opposite one another, the tracks are guided together and connected to one another while the side seams 29 and 30 and also the transverse seams 31 and 32 are formed, with at the same time the coffee portions or subportions 22 and 23 being poured from above into the forming subchambers 20 and 21 via a filling funnel 56.

A further material track 57 of the same width runs in one the side of the track for the blanks 47, which material track 57, in the area of the form rollers 54 and 55, is connected to the facing track for the blanks 47. The material track 57 is first cut through in the longitudinal centre by a fixed blade 58, so that the material strips 50 and 51 are continuously formed from the material track 57. Largely finished infusion bags filled with subportions 22 and 23 are accordingly produced in a work station, which infusion bags merely have to be cut off to length and connected to the actuating handle.

Figure 18:
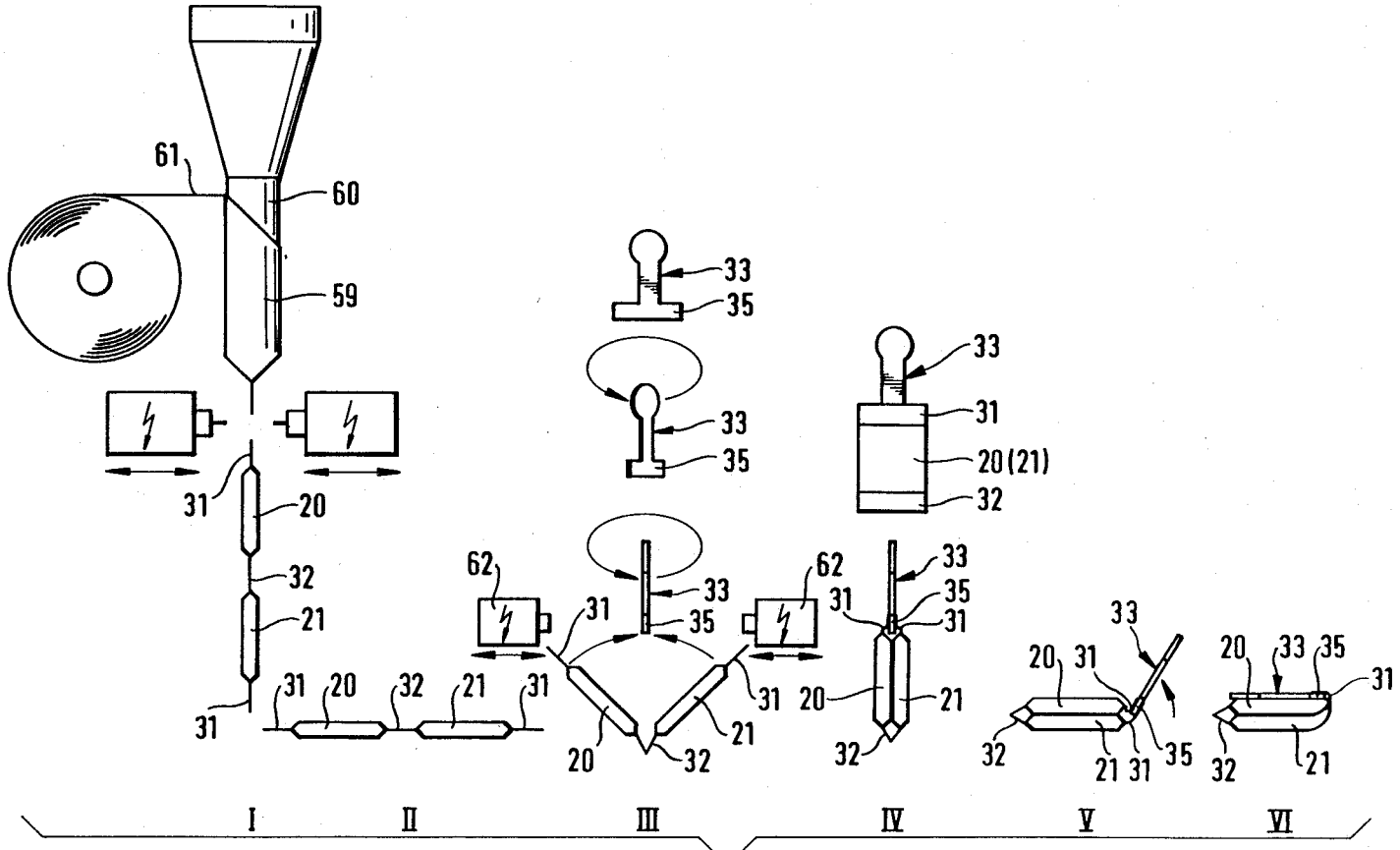
FIG. 18 shows process steps and (schematically) another exemplary embodiment of a device for manufacturing infusion bags, likewise in simplified representation.

In FIG. 18, details on the manufacture of infusion bags from a continuous material tube 59 of (sealable) filter paper are shown in individual process stages I to VI. The material tube 59 is formed on a tubular filling nozzle 60 from a flat, strip-shaped material track 61 and, moveover, is at the same time provided in conventional manner with a tube seal (not shown) running in the longitudinal direction of the material tube 59.

The material tube 59 is moved in stages on the filling nozzle 60, namely drawn off downwards. During a stoppage phase, a subportion 22/23 of the roasted coffee is poured into the material tube via the filling nozzle 60. In the area beneath the filling nozzle 60, a transverse seam 31 or 32 is in each case then applied between successive subportions 22 and 23 with the subchambers 20 and 21 being made. Moreover, the material tube 59 is cut through in the area of the (upper) transverse seam 31, so that elongated objects develop having two filled subchambers 20 and 21.

After they are turned over into a horizontal position according to the process step II, these objects are folded in a U-shape in the area of the lower or centre transverse seam 32 (process step III). The actuating handle 33 is fed in from above in such a way that the transverse web 35 moves into the area between the upper (half) transverse seams 31. SEaling is effected again in the area of the transverse seams 31 by sealing members 62 while the transverse seams 31 are connected to the transverse web 35 of the actuating handle 33.

The infusion bag is now finished according to process stage IV. The actuating handle 33 is then swung via an intermediate position according to V into a packable position IV and bears against one of the subchambers 20 and 21. The finished infusion bag is then wrapped in an aroma-tight foil packing.

We claim:

1. Infusion bag for making beverages from extractable substances in a container containing liquid comprising:

(a) a first and a second subchamber, each subchamber formed by folding a double-layered filter paper and each subchamber accommodating in its interior a portion of the extractable substances, the filter paper of said first and second subchambers having upper and lower transverse edges and the filter paper of said first and second subchambers being connected to each other in the area of their respective lower transverse edges;

(b) rigid actuating means having a rigid actuating handle and a rigid transverse web, said rigid transverse web extending over the width of the subchambers and being integrally formed in one piece with the actuating handle, said rigid transverse web being connected to the filter paper of said first and second subchambers in the area of their respective upper transverse edge so that a hollow space is formed between the two subchambers, the hollow space being variable in shape and volume, and said rigid actuating means having sufficient rigidity such that by moving up and down the rigid actuating means, the subchambers carry out oppositely directed transverse movements relative to each other such that the hollow space changes in size and shape thus acting as a pumping chamber associated with a pumping effect of liquid through the subchambers housing the extractable substances while being supported on the container bottom.

2. The infusion bag according to claim 1 wherein the upper and lower transverse edges are formed as transverse seams.

3. The infusion bag according to claim 1 wherein the actuating handle and the transverse web consists of a rigid plastic.

4. The infusion bag according to claim 1 wherein the first and second subchambers in the area of their lower transverse connection, are at a distance from one another so as to form a section free of extractable substances.

5. The infusion bag according to claim 1, wherein said rigid transverse web is positioned between the first and second subchambers in the area of their respective upper transverse edges.

6. The infusion bag according to claim 1 wherein the two subchambers are of approximately the same size and consist of a common complete blank or of two individual blanks which are connected at their edges by seams forming side seams and transverse seams wherein the subchambers are divided relative to each other by two transverse seams located next to each other.

7. The infusion bag according to claim 6 wherein the hollow space is variable in shape and volume, and in the area of side openings between the respective side seams of said first and second subchambers, the hollow space is provided with shut-off members which close at increased internal pressure in the hollow space to thereby close the side openings and open at reduce internal pressure in the hollow space to thereby open the side openings.

8. The infusion bag according to claim 7 wherein a shut-off member extending approximately up to the center plane of the subchambers is in each case attached to each side seam of the subchambers with adjacent shut-off members bearing against one another with sealing lips upon increased pressure in the hollow space.

9. The infusion bag according to claim 6 wherein the hollow space, in the area of side openings between the respective side seams of said first and second subchambers is provided with shut-off members that close at increased internal pressure in the hollow space to thereby close the side openings and open at decreased internal pressure in the hollow space to thereby open the side openings, the subchambers being formed from two blanks with the outer blank having a larger width than the inner blank, while blank strips are formed which form the shut-off members be folding over towards the inner blank and by subsequent folding of the blanks, connected to one another, in the area of transverse seams.

10. The infusion bag according to claim 6 wherein the hollow space, in the area of the side openings between the respective side seams of said first and second subchambers is provided with shut-off members that close at increased internal pressure in the hollow space to thereby close the side openings and open at decreased internal pressure in the hollow space to thereby open the side openings, the subchambers being formed from two blanks of the same width, with material strips being laterally fixed to the side seams and forming the shut-off members after folding of the blanks in the area of the transverse seams.

11. The infusion bag according to claim 10 wherein the blanks are formed from a continuous material with the material strips also being formed from a continuous material by central cutting of the latter and attaching to the blank.

12. Infusion bag for making beverages from extractable substances in a container containing liquid comprising:

a first and a second subchamber, each subchamber formed by folding a double-layered filter paper and each subchamber accommodating in its interior a portion of the extractable substances, the filter paper of each subchamber being connected along edges of the subchambers to thereby form side seams, the filter paper of said first and second subchambers having upper and lower transverse edges and the filter paper of said first and second subchambers being connected to each other in the area of their respective lower transverse edges; and rigid actuating means having a rigid actuating handle and a rigid transverse web, said transverse web extending over the width of the subchambers and being integrally formed in one piece with the actuating handle, said rigid transverse web being connected to the filter paper of said first and second subchambers in the area of their respective upper transverse edges so that a hollow space is formed between the two subchambers, the hollow space being variable in shape and volume and said hollow chamber, in the area of side openings between the respective side seams of said first and second subchambers, being provided with shut-off members that close at increased internal pressure in the hollow space to thereby close the side openings and open at reduced internal pressure in the hollow space to thereby open the side openings, said rigid actuating means having sufficient rigidity such that up and down movement of the rigid actuating means causes the first and second subchambers to carry out oppositely directed transverse movements relative to each other such that the hollow space changes in size and shape thus acting as a pumping chamber associated with a pumping effect of liquid through the subchambers housing the extractable substances while being supported on a bottom portion of the container.

* * * * *